United States Patent [19]

Andersen et al.

[11] 4,098,668

[45] Jul. 4, 1978

[54] ELECTROLYTE METAL EXTRACTION

[75] Inventors: Allen K. Andersen, Arvada, Colo.; Vsevolod Archipov, Decatur, Ala.

[73] Assignee: Continental Copper & Steel Industries, Inc., New York, N.Y.

[21] Appl. No.: 717,057

[22] Filed: Aug. 23, 1976

Related U.S. Application Data

[60] Continuation of Ser. No. 499,257, Aug. 21, 1974, abandoned, which is a continuation of Ser. No. 266,644, Jun. 27, 1972, abandoned, which is a continuation of Ser. No. 851,518, Jun. 23, 1969, abandoned, which is a division of Ser. No. 611,198, Dec. 12, 1966, Pat. No. 3,483,568, which is a continuation-in-part of Ser. No. 530,147, Feb. 25, 1966, abandoned.

[51] Int. Cl.[2] ..... C25C 1/12; C25C 7/00

[52] U.S. Cl. ..... 204/237; 204/105 R; 204/275

[58] Field of Search ..... 204/105, 237, 266, 106, 204/80, 268, 275, 263, 270

[56] References Cited

U.S. PATENT DOCUMENTS

| | | | |
|---|---|---|---|
| 669,439 | 3/1901 | Frasch | 204/237 |
| 720,235 | 2/1903 | Frasch | 204/237 X |
| 950,973 | 3/1910 | Wallace | 204/237 |
| 1,600,730 | 9/1926 | Haffner | 204/275 X |
| 2,199,942 | 5/1940 | Staudt | 204/270 |
| 3,477,939 | 11/1969 | Kircher | 204/268 |
| 3,503,856 | 3/1970 | Blackmore | 204/275 X |
| 3,503,858 | 3/1970 | Crane | 204/268 X |
| 3,558,466 | 1/1971 | Lebrizzi et al. | 204/275 |
| 3,622,478 | 11/1971 | Beyer | 204/237 X |

*Primary Examiner*—Arthur C. Prescott
*Attorney, Agent, or Firm*—Arthur A. March

[57] ABSTRACT

An apparatus for the electroseparation of a metal from an impure solution containing such metal which comprises a vessel for the electrolyte fitted with anodes and cathodes arranged to be immersed in the electrolyte and means for circulating the electrolyte successively across the face of the anode and thereafter across the face of the cathode.

5 Claims, 8 Drawing Figures

ELECTROLYTE METAL EXTRACTION

This application is a continuation of copending application Ser. No. 499,257, filed Aug. 21, 1974 now abandoned, which is a continuation of copending application Ser. No. 266,644, filed June 27, 1972 now abandoned, which in turn is a continuation of copending application Ser. No. 851,518, filed June 23, 1969 now abandoned, which in turn is a division of copending application Ser. No. 611,198, filed Dec. 12, 1966, now U.S. Pat. No. 3,483,568 which is a continuation-in-part of application Ser. No. 530,147, filed Feb. 25, 1966 now abandoned.

This invention broadly relates to the art of metal extraction and more particularly to extraction of metals by electroseparation.

In extracting metals from ore it has been customary after dressing the ore to further process the metal by means of fire refining, hydrometallurgy, and by the use of chemical reagents. However, with the depletion of the reserves of metallic ore of relative high purity, additional processing has been necessary in order to remove the large amount of impurities which remain after the preliminary processing. Conventionally, one of the methods utilized for such separation is the electrolytic process. This includes the steps of first dissolving the ore and thereafter electrolyzing the resulting solution in a container having anode and cathode electrodes partially immersed in the solution. A difference of potential is maintained between the anode and cathode electrode to supply an electric current to the solution to cause ions of the desired metal to be reduced from the ionized state to a neutral state and to deposit on the cathode electrode or electrodes.

In conventional electroseparation processes, including electrowinning and electrorefining, the flow of fresh electrolyte is from one end of the container or cell to the other end past a series of anodes and cathodes with spent electrolyte being withdrawn from the opposite end of cell from the introduction of fresh electrolyte. It may be readily understood that the chemistry and physical characteristics of the electrolyte are changing continuously during its passage through the cell since the valued metal is being continuously removed from the electrolyte as it passes each series of anodes and cathodes. Consequently, the electrolyte progressively becomes depleted in the valued metal sought and the ratio of impurities to valued metal continuously increases thereby making the conditions of electroseparation less ideal as the solution progresses through the cell to the point where electrical current efficiencies are substantially reduced, the product cathode deteriorates in chemical and physical quality, and finally the cell ceases to produce a useful product. This phenomena fundamentally limits both the maximum impurity content of the incoming fresh electrolyte or of the soluble/corrodable anodes and the number of anode-cathode units that may be arranged in a cell.

When using low grade ores of great impurity, which presently constitute the bulk of the world's known reserves, it was virtually impossible to utilize the electroseparation processes without first purifying the solution. Unless such pre-purification took place, the metal deposited on the cathode was impure and not usable. The costs attendant upon purifying the solution made the process impractical from an economic standpoint.

It is therefore an object of the present invention to provide a process and apparatus which utilizes electroseparation to extract pure metals from very impure and low grade ores.

Another object of the present invention is to provide a process and apparatus by means of which pure metal can be extracted from solutions of very impure and low grade ores without requiring any preliminary processing or purifying.

It is a further object of the present invention to provide a process and apparatus by which the pure metal may be extracted from solutions of very impure and low grade ores in a simple, efficient and yet extremely economic manner.

An advantage obtained by the present invention is the general benefit derived by economic extraction of pure metal from solutions of low grade and impure ores.

Still another advantage obtained by the present invention is that higher current densities may be used for the extraction of various metals, including copper, than those current densities which were able to be used heretofore.

Other objects and advantages are apparent in the following specification taken in conjunction with the accompanying drawings. It is to be understood that the drawings and descriptions are merely illustrative and are in no way intended to limit the scope of the invention.

For illustrative purposes the invention will be described in connection with the extraction of copper from a copper feed solution. This had been done only to demonstrate the invention which may be equally effectively utilized for the extraction of other metals such as zinc, nickel, chromium, etc.

Figure 1:
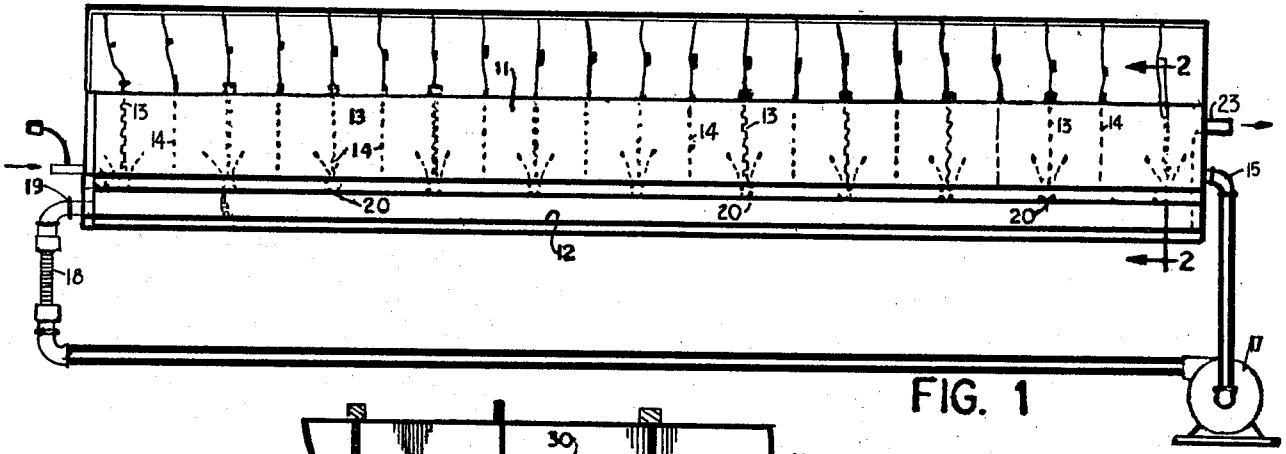
FIG. 1 is a simplified cross-sectional view of one embodiment of the present invention showing an electrolytic tank constructed according to the invention and used for carrying out the electrowinning process of the invention.

In FIG. 1 there is shown a particular cell construction which has been found to be very advantageously usable in following the process of the present invention. The tank 11 is provided with a lower channel 12. The tank contains several anodes 13 constructed for the illustrative production of copper, of 6% antimony in lead and a plurality of cathodes 14 constructed of reagent grade copper heavy foil. In the tank 11 there are shown eleven anodes and ten cathodes spaced apart and all comprising flat sheets parallel to each other. Obviously, anodes and cathodes of different shapes and in different amounts may be utilized for the extraction of metal under varying conditions. The lower edge of each of the illustrated sheets 13 and 14 is spaced from the false bottom 12 to permit the electrolyte to flow between the lower edges of the sheets and the upper surface of the false bottom.

To extract copper using the cell illustrated, a copper-bearing feed solution is either pumped or is gravity fed into an inlet pipe 15. The electrolyte is withdrawn from the other end of the tank 11 through an outlet pipe 16 and is pumped by a suitable pump 17 through a rotameter 18 into the false bottom inlet 19 of the cell. The electrolyte travels between the true bottom of the cell 11 and the false bottom 12 and up through a plurality of small ports 20 located adjacent to and beneath each of the anodes 13.

The anodes and cathodes are wired to their respective bus bars, of which only the bus bar 22 is shown, running along and over the top of the cell 11. It is not necessary that these bus bars be located overhead, as conventional means of electrical contact are adequate. The liquor, which is also referred to as the spent electrolyte, flows out of the cell 11 by way of an outlet pipe 23 in quantities equal to the feed input less the evaporative losses.

Figure 3:
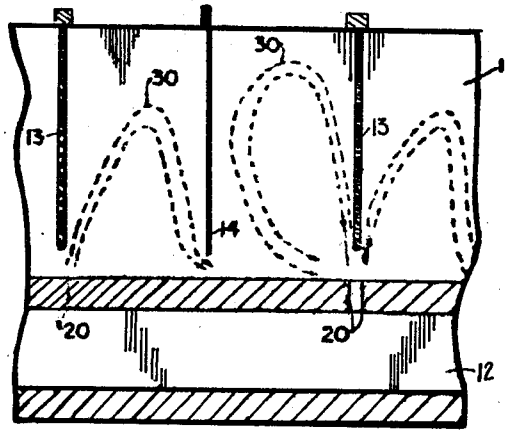
FIG. 3 is an enlarged cross-sectional view of one section of the tank of FIG. 1.
Figure 2:
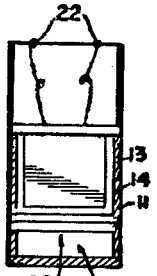
FIG. 2 is a cross-sectional end view of the tank of FIG. 1.
Figure 5:
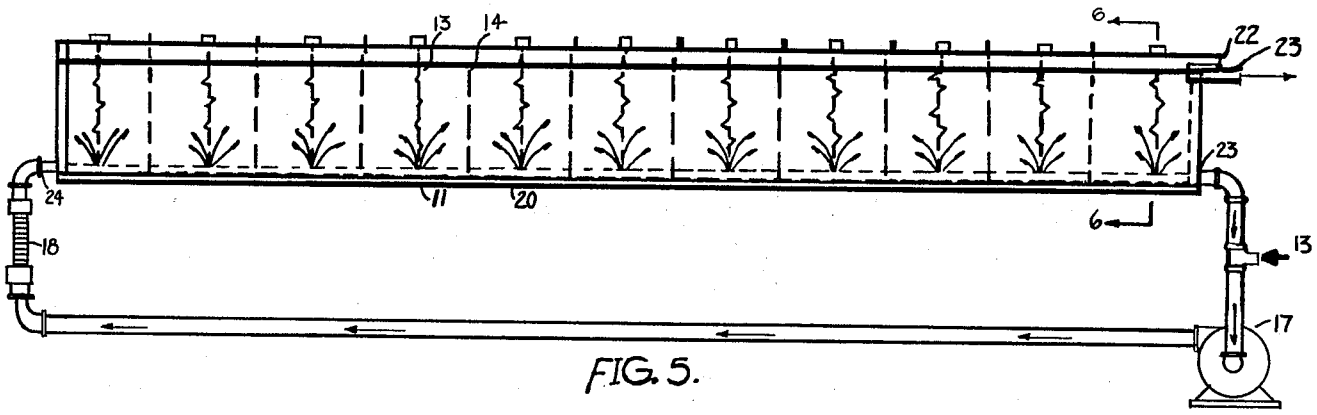
FIG. 5 is a simplified cross-sectional view of another embodiment of the present invention showing an electrolytic tank constructed according to the invention and usable to carry out the process of the invention.
Figure 7:
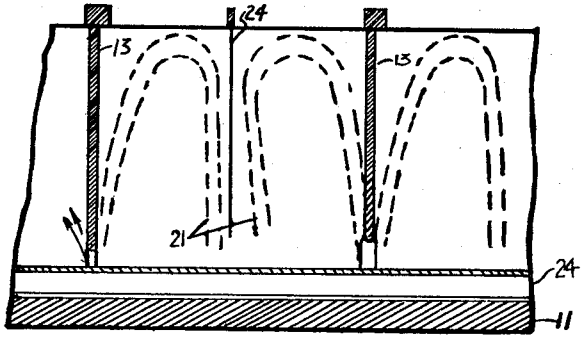
FIG. 7 is an enlarged cross-sectional view of one section of the tank of FIG. 5.

FIG. 3 illustrates a novel flow pattern of the present invention. The recirculating electrolyte provides a complete circulation path 30 around each cathode 14. Thereafter, the electrolyte flows underneath the anodes and cathodes and out toward the right as indicated by the flow arrows.

Figure 4:
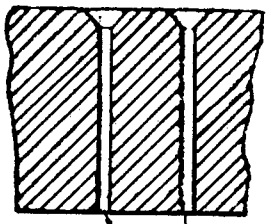
FIG. 4 is an enlarged cross-sectional view of flow-controlling holes in the false bottom of the tank of FIGS. 1–3.

One pair of inlet ports 20 is shown in greater detail in FIG. 4. As may be seen, the upper ends of the inlet ports 20 are countersunk in order to produce a desired flow pattern of the electrolyte. Of course other means may be used to obtain the necessary flow pattern.

This invention is not limited to use of a specific form of electrolytic tank and another form of tank as illustrated in FIGS. 5 through 8 may be utilized. Wherever possible the same numbers have been utilized to identify similar portions of the tank construction.

As shown, a conventional tank 11 contains several anodes 13 and cathodes 14 constructed as described in connection with the tank illustrated in FIG. 1. An inlet pipe 24 and outlet pipes 25 are set along the bottom of the tank. In this construction the lower edge of each of the electrodes 13 and 14 is spaced from the flow controlling inlet and outlet pipes 24 and 25 so that the electrolyte flow in the area of the cathode surfaces is substantially free from turbulence. The metal-bearing feed solution or liquor is recirculated by means of a suitable pump 17 in the direction of the arrows through a metering device 18 and into the inlet pipe 24. The solution then travels up through a plurality of small ports or openings 26 which are disposed adjacent to and beneath the anodes 13. As shown, the flow is directed up to the surface and progresses downwardly along each cathode surface to a plurality of small outlet ports 27 provided in the outlet pipes 25. The outlet ports are located adjacent to and beneath each of the cathodes 14. As indicated with reference to FIGS. 1–4, the anodes and cathodes are wired to their respective bus bars exemplified by bus bar 22. The liquor flows out of the cell from the outlet pipes 25 in quantities equal to the feed input less the evaporative losses.

Figure 8:
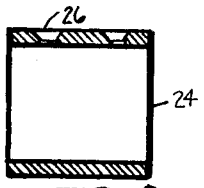
FIG. 8 is an enlarged cross-sectional view of flow-controlling holes in the pipes placed along the bottom of the tank of FIGS. 5–7.
Figure 6:
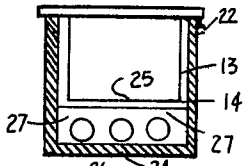
FIG. 6 is a cross-sectional end view of the tank of FIG. 5.

FIG. 8 shows the detail of one of the pipes 24 which is illustrated with the ports 26 countersunk. It will be understood that this construction eliminates any interference of the flow of the solution which might otherwise be caused by metal burrs or fragments which remain after drilling the holes. However, the ports may be of any desired construction.

The present invention includes the discovery of the phenomena and unanticipated results which occur by directing the electrolyte along a predetermined path through a cell utilizing a predetermined electrolyte flow velocity between the anodes and the cathodes.

A process is provided for recovering high purity metals from solutions whose impurities were such that it would be impractical to attempt to recover the desired metals therefrom. The use of the process prevents the build-up in concentration of undesirable ions at the anode and cathode surfaces of an electrolysis cell while, at the same time, enables the concentration of the desired ions of the solution-electrode interface to remain sufficiently high to achieve their practical neutralization and discharge. Specifically, the fluid flow characteristics of the ion-pregnant solution at the solution-electrode interface are controlled in such a manner that the desired metal can be plated in high purity form from a solution containing high concentrations of undesirable ions as impurities without neutralizing the undesirable ions or providing impractical or uneconomic means for their control or prior elimination from the solution.

More specifically we have discovered that the circulation pattern located between the individual anode-cathode pairs which controls the quality of the cathode product produced is related to the flow characteristics of the electrolyte entering the anode-cathode area. Consequently, it is possible to establish a relationship between these entry flow characteristics and the quality of the cathode product produced. By control of these entry flow characteristics it is thereby possible to recover metals from solutions without any expensive and most times impossible pre-purification processing.

The fluid flow characteristics of the electrolyte using the process of the present invention may be measured by means of a Reynolds number. The Reynolds number is a pure dimensionless number and is calculated by means of the following equation.

Reynolds number $= DV\rho/\mu$ where:

$V$ = velocity at the entrained port in the cross-section measured in feet/second $D$ = diameter of the port in feet $\rho$ = the electrolyte density in pounds (mass) per cubic feet $\mu$ = viscosity of electrolyte in pounds (mass per foot per second Exemplary of the calculation of the Reynolds number are situations wherein D is $\frac{1}{8}$ in., V is 1.84, $\rho$ is 79.4 and $\mu$ is 0.00289. With this data the Reynolds number is 526. Another example is a situation in which D is 1/16, V is 7.41, $\rho$ is 79.4 and $\mu$ is 0.00289. Under such conditions the Reynolds number is 885. It has been found that in accomplishing the results of the present invention, velocities, diameters, electrolyte density and electrolyte viscosity of such nature are used that the Reynolds number is above approximately 60.

The Reynolds number utilized depends upon such measurable factors as the size of the inlet port, the velocity of the flow of the liquid in the point of entry, both taken in conjunction with the density of the electrolyte and its viscosity. This number is calculated from the foregoing equation as shown by the following:

ILLUSTRATIVE EXAMPLES

Where the diameter of the port is ⅛ inch, the velocity in the entrance port, is 0.21 ft./sec.; the density of the electrolyte is 79.4, the viscosity of the electrolyte is 0.00289 and the impurity consists of aluminum or the like, the Reynolds number is 60 and the excellent results of extracting pure copper are obtained.

Where the diameter of the port is ⅛ inch, the velocity in the entrance port is 1.84 ft./sec. the density of the electrolyte is 79.4, the viscosity of the electrolyte is 0.00289, and the impurity comprises ferric ions, the Reynolds number is 526 and the results are excellent.

Where the diameter of the port is 1/16 inch, the velocity in the inlet port is 7.41 ft./sec., the density of the electrolyte 79.4, the viscosity of the electrolyte is 0.00289 and the impurity comprises ferric ions, the Reynolds number is 1060, and the results are excellent.

Where the diameter of the inlet port is ½ inch, the velocity of the inlet port is 0.115 ft./sec., the density of the electrolyte is 79.4, the viscosity of the electrolyte is 0.00289 and the impurity comprises ferric ions, the Reynolds number is 66, and the results are good.

Where the diameter of the port is 1/64 inch, the velocity in the inlet port is 29.55 ft./sec.; the density of the electrolyte is 79.4, the viscosity of the electrolyte is 0.00289, and the impurity comprises ferric ions, the Reynolds number is 1055, and the results are excellent.

Where the diameter of the port is ¼ inch, the velocity in the inlet port is 0.46 ft./sec., the density of the electrolyte is 79.4, the viscosity of the electrolyte is 0.00289 and the impurity comprises ferric ions, the Reynolds number is 263, and the results are excellent.

Where the diameter of the port is ⅜ inch, the velocity in the inlet port is 22.3, the density of the electrolyte is 79.4, the viscosity of the electrolyte is 0.00289 and the impurities comprise ferric ions, chloride ions and aluminum and the Reynolds number is approximately 1917 and the results are good.

Where the diameter of the port is ⅛ inch, the velocity of the inlet port is 14.32 ft./sec, the density of the electrolyte is 71.26, the viscosity of the electrolyte is 0.00163 and the impurity comprises ferric ions, manganese ions, and chloride ions, the Reynolds number is 6521.2, and the results are excellent.

Where the diameter of the port is 5/32 inch, the velocity of the inlet port is 24.3 ft./sec, the density of the electrolyte is 73.13, the viscosity of the electrolyte is 0.00237, and the impurity comprises ferric ions and chloride ions, the Reynolds number is 9763.2 and the results are excellent.

Where the diameter of the port is 7/32 inch, the velocity of the inlet port is 17.4 ft./sec., the density of the electrolyte is 73.13, the viscosity of the electrolyte is 0.00237, and the impurity comprises ferric ions and chloride ions, the Reynolds number is 9787.3, and the results are excellent.

Where the diameter of the port is 7/32 inch, the velocity of the inlet port is 17.4 ft./sec., the density of the electrolyte is 72.38, the viscosity of the electrolyte is 0.00190, and the impurity comprises ferric ions and chloride ions, the Reynolds number is 12,083.1 and the results are excellent.

Where the diameter of the port is 5/32 inch, the velocity of the inlet port is 26.8 ft./sec., the density of the electrolyte is 71.26, the viscosity of the electrolyte is 0.00163, and the impurity comprises ferric ions and chloride ions, the Reynolds number is 15,255.6 and the results are excellent.

It will be understood that the illustrative examples refer to cells of a size ranging from a 3 inch electrolyte depth to a 3 foot electrolyte depth. In view of the fact that the velocity in the inlet port may vary depending upon the depth of the tank, the Reynolds numbers will accordingly change depending upon the solution depth.

It is possible to predetermine the flow characteristics necessary by precalculating the Reynolds number. As observed it has been found that Reynolds numbers of over approximately 60 must be utilized taking into consideration all conditions of impurities of the solution and the practical dimensions of the port size, the size of the cell, and the velocity in the inlet port.

While this description refers to an illustrative means for accomplishing the type of circulation illustrated in the drawings this circulation may be obtained in various ways. The pattern of flow utilized is quite advantageous because the downward circulation at the cathode tends to cause any dendritic formation to be in the vertical direction in preference to a lateral growth. This eliminates the difficulties heretofore encountered with cathode growth increase to the point where a shorting condition is established with the anode.

The dramatic nature of the improvements obtained in the extraction of metals from impure ores using the present invention is illustrated in Table I below. This Table shows the results of tests in which an exemplary metal, viz copper, was attempted to be extracted from an impure electrolyte solution using the processes of the prior art and compares those results with the results obtained using the processes of the present invention.

TABLE I

| | Electroseparation Tests | |
|---|---|---|
| Various Operating Parameters | Electrolyte Circulating Fluid Characteristics Using the Process of the Prior Art in a Cell Havng 11 Anodes and 10 Cathodes and a Flow Rate of Approximately 10 gal. per min. per sq. ft. | Electrolyte Circulating Fluid Characteristics Using the Processing of this invention with a Reynolds Number of Over 400 and Using 10 Anodes and 10 Cathodes with a Flow Rate of Approximately 10 gal. per min. sq. ft. |
| 1. A Current densities higher than 16 amps/ft.$^2$. | Cathode production mainly a poorly adhering powder unsuitable for use. | Cathode solid and crystalline to the max. current density tested - 45 amps/ft.$^2$. |
| 2. Concentrations of $Al_1(SO_4)_3$ to a maximum of 150 g./l. | Cathode production formed to a useless powder at 30 g./ 1. $Al_2(SO_4)_3$. | Cathode solid and very crystalline to a max. concentration of $Al_2(SO_4)_3$ tested - 150 g./l. |
| 3. Concentration of Mn to a max. of 2 g./l. | Cathodes of poor quality - low current efficiencies (60–70%) - harmful permanganate formation. | Cathode solid and crystalline at circulation rates of greater than 8 gpm/ft.$^2$. No permanganate formation. |
| 4. Concentration of Cu to maximum of 45 g./l. | Cathode turned to useless powder and efficiencies lowered at concentraions of less than 16 g./l. | No powder formation at cathode until Cu concentration lowered below 8 g./l. |
| 5. Concentration of $Cl^-$ to a max. of 1.05 g./l. | At 0.2 to 0.4% $Cl^-$ in solution, cathodes contained 1 to 1.5% $Cl^-$. | Cathode $Cl^-$ content did not reach 1 to 1.5% until solution contained 0.8 to 1.05 g./l. $Co^-$ |
| 6. Concentration of 4 g./l. $Fe^{+++}$ ions and 1 g./l. $Cl^{31}$ ions. | Cathode production a useless copper powder. | Cathode production solid and crystalline - no powder production. |

TABLE I-continued

| Various Operating Parameters | Electroseparation Tests: Electrolyte Circulating Fluid Characteristics Using the Process of the Prior Art in a Cell Havng 11 Anodes and 10 Cathodes and a Flow Rate of Approximately 10 gal. per min. per sq. ft. | Electrolyte Circulating Fluid Characteristics Using the Processing of this invention with a Reynolds Number of Over 400 and Using 10 Anodes and 10 Cathodes with a Flow Rate of Approximately 10 gal. per min. sq. ft. |
|---|---|---|
| 7. Desdritic growth from solution concentrations shown above. | Excessive growth and very low current efficiency (75%). | Insignificant growth - -0 current efficiency 85%. |
| 8. Acid concentration 30 g./l. | Voltage required minimum of 3 volts. | Voltage required 2.1 volts. |

The tests from which the Table was prepared clearly discloses that where the processes of the present invention were followed, pure copper was obtained with:

1. Much higher current density;
2. Much higher concentrations of $Al_2(SO_4)_3$;
3. A manganese concentration up to at least 2 g./l.;
4. Much lower copper concentrations;
5. Much higher chloride concentrations;
6. Much higher combined concentrations of ferric and chloride impurities;
7. Substantially reduced harmful impurities;
8. Substantially improved current efficiency; and
9. Lower voltage for a given electrolyte strength.

The extraction of pure copper from the impure solution is therefore effectively obtained under all adverse conditions when using the process described herein.

In addition to the impurities above set forth, metals have been electroseparated from other impurities present in the electrolytes by using the process of the present invention. Such impurities include gypsum and silica as well as nitrate concentrations of up to 1 g./l. Significantly, the process of the present invention does not require the use of the expensive electroseparating aids as is necessary when using the processes of the prior art. In fact, when using the present invention, 99.95% copper is obtained from the very impure solutions as set forth in Table I. Indicative of the small amount of impurities remaining in the copper is the result of the impurity analysis which are set forth in Table II below.

TABLE II

| Impurity Analysis of Copper Recovered with the Use of the Present Invention As Illustrated in Table I | |
|---|---|
| Silicon | 0.0022 % |
| Magnesium | 0.00036 |
| Lead | 0.010 |
| Iron | 0.0005 |
| Aluminum | 0.001 |
| Silver | 0.00029 |
| Calcium | 0.0074 |

and the remainder of the impurities is primarily oxygen.

Using the flow pattern characteristics of our process, the illustrative cell of FIG. 1 has been found to operate successfully at current densities varying from 5 to 45 amp/ft.$^2$, with the major portion of the data recorded at 30 amp/ft.$^2$, in place of the normal 7–18 amp/ft.$^2$ current density of prior cells not embodying this invention. The difference of potential between the anodes and cathodes is approximately 2.1 volts at a current density of about 30 amp/ft.$^2$ with acid concentrations of not less than about 29 g./l. of sulphuric acid ($H_2SO_4$). The voltages, of course, are determined basically by the electromotive series. When using cells absent this invention, polarization would necessitate a somewhat higher voltate which, in turn, would tend to cause undesired metal ions to electrolyze out of solution. For example, a higher voltage would tend to cause ferric ions to be reduced in addition to the desired copper. Ferric ions are frequently found in copper ore, and their presence is one of the factors that must be given special consideration in using electroseparation apparatus and processes. However, these are not the only troublesome ions commonly present as impurities in the solution.

A current efficiency of 85% is considered a favorable economic lower limit for the production of copper. The determination of this efficiency is based on the fact that one Faraday would theoretically produce one gram equivalent weight of copper if the efficiency were 100%. It has been found that a cell constructed and operated in accordance with this invention will operate with an efficiency of at least 85% even in the presence of abnormally high concentrations of manganese, aluminum sulfate, chloride ions, nitrate ions and other impurities in the electrolyte solution.

Variations in the concentrations of undesired ions and their effect on the operation on the cell of the present invention are shown in the following Table III. In each of the examples the designation "head" indicates the composition of the initial leach liquor as it enters the cell and the designation "spent" indicates the composition of the material after copper ions have been reduced to metallic copper. Concentration of the ions, or chemicals, are indicated in grams per liter.

TABLE III

| Test Utilizing the Process of the Present Invention at a Reynolds Number of Over 400 | | | | | | | | | |
|---|---|---|---|---|---|---|---|---|---|
| Solution | g./l. Cu | g./l. $H_2SO_4$ | g./l. $Fe^{+3}$ | g./l. Cl | g./l. Mn | g./l. NO | Average Voltages Recorded | Assay of Copper Cathode | Current Efficiency |
| | | | | | Example I | | | | |
| Head | 21.76 | 8.93 | 1.03 | 0.41 | 0.36 | 0.06 | 2.3 | 99.96% | 92.3% |
| Spent | 9.16 | 34.24 | 1.15 | 0.46 | 0.36 | 0.04 | | | |
| | | | | | Example II | | | | |
| Head | 23.48 | 28.15 | 1.32 | 0.43 | 0.40 | 0.09 | 2.15 | 99.95 | 92.1 |
| Spent | 18.16 | 43.04 | 1.56 | 0.46 | 0.41 | 0.07 | | | |
| | | | | | Example III | | | | |
| Head | 28.65 | 27.14 | 1.66 | 0.51 | 0.40 | 0.07 | 2.15 | 99.97 | 91.5 |
| Spent | 21.48 | 42.95 | 1.72 | 0.61 | 0.92 | 0.11 | | | |
| | | | | | Example IV | | | | |
| Head | 30.78 | 40.66 | 1.12 | 0.60 | 0.37 | 0.08 | 2.1 | 99.96 | 91.6 |
| Spent | 25.21 | 56.38 | 1.54 | 0.49 | 0.37 | 0.05 | | | |
| | | | | | Example V | | | | |

TABLE III-continued

| Test Utilizing the Process of the Present Invention at a Reynolds Number of Over 400 | | | | | | | | | |
|---|---|---|---|---|---|---|---|---|---|
| Solution | g./l. Cu | g./l. $H_2SO_4$ | g./l. $Fe^{+3}$ | g./l. Cl | g./l. Mn | g./l. NO | Average Voltages Recorded | Assay of Copper Cathode | Current Efficiency |
| | | | | | Example I | | | | |
| Head | 28.8 | 2.86 | 2.07 | 0.63 | 0.52 | 0.11 | 2.36 | 99.95 | 90.8 |
| Spent | 22.4 | 17.0 | 2.19 | 0.49 | 0.48 | 0.16 | | | |
| | | | | | Example VI | | | | |
| Head | 44.3 | 5.7 | 3.1 | 0.46 | 0.65 | 0.34 | 2.1 | 99.94 | 87.4 |
| Spent | 22.5 | 80.6 | 3.4 | 0.48 | 0.69 | 0.4 | | | |
| | | | | | Example VII | | | | |
| Head | 30.0 | 15.8 | 4.29 | 0.46 | 1.87 | 0.79 | 2.09 | 99.93% | 85.3% |
| Spent | 15.1 | 87.9 | 4.50 | 0.48 | 2.23 | 0.93 | | | |

As observed, ferric ions represent one of the most troublesome cations because of their efficiency lowering characteristics and chloride ions represent one of the most troublesome anions because of the possible insoluble cuprous-chloride deposit and the fourth column of the table shows that their concentration does not change appreciably, even in examples 4 and 5, while in examples 1, 2, 6 and 7 the concentration of chloride ions increases as the copper is reduced. With the processes of the prior art chloride levels of about 0.1 g./l. are considered to be the maximum that can be tolerated. Beyond that point extraction of pure metals is not possible and if the incoming ore contains enough soluble chloride material to increase the chloride levels about 0.1 g./l. additional costly and impractical preliminary purification processes have been necessary. With the use of the present invention, however, chloride levels at least twice as high can be tolerated while nevertheless extracting substantially pure metal.

The normal maximum concentration of ferric ions of the prior art is about 2.0 – 2.5 g./l. with the present invention pure metal may be extracted with ferric ion concentrations at least twice as high. In many cases this permits the dissolved-ore copper to be run directly into the cell without any preliminary diminution of the ferric ions.

Examples 6 and 7 show that the efficiency of the present invention is still better than 85% even with quite high concentrations of ferric ions. In example 7, not only the ferric ions but also the manganese and nitrate ions are present in high concentration without driving the efficiency of operations below 85%.

Typical operating conditions according to the present invention include an electrolyte temperature of 50–55° C. which may be held within this range by suitable heaters or other means. The circulating rates that have been used in practice vary from the 1.0 to 4 gal. per min. in a cell having a total electrolyte volume of 2.1 gal. and a cathode-to-cathode center spacing of 5 inches. The conductivity, and hence the voltage, of the cell may be held in the proper range by adding sufficient $H_2SO_4$ to maintain a free acid concentration of approximately 30 g./l. When the ferric concentrations reach levels higher than 4 g./l., the circulating rate is increased from the normal 0.6 ga. per min. to approximately 0.9 gal. per min. which, in this embodiment, represents a Reynolds number of approximately 400 in a 3/16 in. diameter port. No additives of any kind need be employed, although it may be desirable to use cover oil to prevent excessive evaporation and an acid-oil to prevent excessive sprout growth.

While conventional processes produce very poor cathodes and operate at low current efficiency if manganese ions are present to any extent, the present process operates with a minimum circulation of less than 0.5 gal. per min., which prevents the formation of permanganate because the circulation reduces the contact time necessary for oxidation of the manganese to the $MnO_4$-.

Moreover, with conventional processes, concentration of aluminum sulfate of 150 g./l. results in a very poor copper deposit but with the present invention with a minimum circulation of less than 0.6 gal. per min. there is substantially no deleterious effect from aluminum concentrations as high as this.

With the use of our process there is no deleterious dendrite growth as was the case when using the same solutions in prior known processes.

It is to be noted that in the use of the present invention, the cell illustrated has produced pure copper at a rate of approximately 1 lb. per kilowatt hour of D.C. electrical power.

It is further of great significance that it has been demonstrated that the examples presented in Table I establish the workability of the present invention where as prior known practices were totally unable to produce a useful product. It will be recognized that in situations where the impurities are at a level intermediate to those discussed above and where previously known practices may produce a suitable useful product with considerable difficulty, use of the present invention will produce a product of improved quality, with less difficulty, more economically and with far higher efficiency. Table III illustrates several examples where production of high purity copper was possible at high efficiencies from very impure solutions by the practice of this invention.

In accordance with the present invention, higher current densities, viz., 31.3 amps/ft$^2$ and higher, may be utilized whereas they are not presently usable in conventional techniques heretofore known.

In addition, a much larger copper drop in the electrolyte solution is feasible, for example, a drop to 8 g./l. as compared with the conventional 13 g./l. This copper drop may be used with approximately the same efficiencies and power consumption rates as are now obtainable using conventional techniques.

The process and techniques of the present invention have resulted in metal deposits of good quality from solutions whose impurity concentrations were such that recovery would heretofore have been considered electrolytically impossible.

While the illustrations set forth involve for the most past the processing of copper, the invention is equally efficient when utilized in the extraction of zinc, nickel, chromium and all similar metals which are subject to electroseparation.

It will be understood that we have attempted to describe in great detail the present invention, including the process and a specific apparatus. It is to be understood that this description is in no way intended to limit the invention and that variations and modifications may be made by those skilled in the art without in any way departing from the spirit of the invention as defined in the appended claims.

We claim:

1. Electroseparation apparatus for extracting metal from an electrolyte solution containing ions of said metal comprising:

a relatively elongate vessel having end walls and side walls adapted to receive a quantity of electrolyte, an anode plate and a cathode plate arranged in the vessel in proximity to each other with the wide faces of the plates being at substantially right angles to the side walls and with the plates being at a level adapted to be at least partially immersed in such quantity of electrolyte, and means for continuously circulating the electrolyte through the vessel, including a pump, inlet means located beneath the plates and arranged adjacent the anode plate and remote from the cathode plate for introducing the electrolyte initially upwardly along the anode plate and thence downwardly along the cathode plate, and outlet means separated from the inlet means for withdrawing the electrolyte from the vessel for circulation by the pump back to the inlet means, whereby the electrolyte flows from the inlet means to the outlet means in an arc successively across the corresponding faces of the plates to deposit relatively pure metal onto the cathode plate from the electrolyte solution.

2. Apparatus according to claim 1 wherein the inlet means comprise a pipe having apertures adjacent the anode plate and remote from the cathode plate, and the outlet means comprise a pipe having apertures.

3. Apparatus according to claim 2 wherein the inlet and outlet pipes extend substantially from one end wall to the other end wall of the vessel.

4. Apparatus according to claim 1 wherein the outlet means comprise pipes located adjacent the bottom edges of the plates, and the inlet means comprise a pipe located between the outlet pipes and having apertures adjacent the anode plate and remote from the cathode plate.

5. Apparatus according to claim 1 wherein a plurality of such anode plates and cathode plates, each comprising a substantially flat sheet, is arranged statically in spaced apart opposed alternate tandem disposition successively along the vessel, with the wide faces of the plates being at substantially right angles to the side walls and with the plates being at a level adapted to be at least partially immersed in such quantity of electrolyte, and the inlet means include a plurality of introduction apertures located beneath the plates and successively distributed adjacent the respective faces of the anode plates and remote from the respective faces of the opposed cathode plates for introducing the electrolyte initially upwardly along the correspondingly adjacent faces of the anode plates and thence downwardly along the correspondingly opposite adjacent faces of the cathode plates, whereby the electrolyte flows from the inlet means to the outlet means in corresponding arcs successively across the faces of the anode plates and thereafter across the faces of the cathode plates to deposit relatively pure metal onto the cathode plates from the electrolyte solution.

* * * * *